United States Patent [19]

Sixsmith et al.

[11] 4,325,672

[45] Apr. 20, 1982

[54] REGENERATIVE TURBO MACHINE

[75] Inventors: Herbert Sixsmith, Oxford; Robert E. Poole, Wilby, England

[73] Assignee: The Utile Engineering Company Limited, Northamptonshire, England

[21] Appl. No.: 102,578

[22] Filed: Dec. 11, 1979

[30] Foreign Application Priority Data

Dec. 15, 1978 [GB] United Kingdom ..... 48621/78

[51] Int. Cl.[3] ..... F04D 5/00

[52] U.S. Cl. ..... 415/53 T; 415/198.2; 415/213 T

[58] Field of Search ..... 415/53 T, 198.2, 213 T

[56] References Cited

U.S. PATENT DOCUMENTS

| | | | |
|---|---|---|---|
| 1,619,285 | 3/1927 | Burks | 415/213 T |
| 1,689,579 | 10/1928 | Burks | 415/198.2 |
| 3,135,215 | 6/1964 | Smith | 415/198.2 |
| 3,782,850 | 1/1974 | Egli et al. | 415/53 T |

FOREIGN PATENT DOCUMENTS

| | | | |
|---|---|---|---|
| 2612118 | 10/1976 | Fed. Rep. of Germany | 415/53 T |
| 41338 | 8/1915 | Sweden | 415/53 T |

*Primary Examiner*—Louis J. Casaregola

*Attorney, Agent, or Firm*—Norris & Bateman

[57] ABSTRACT

A regenerative fluid dynamic machine, typically a blower or exhauster, includes a rotor (21) having a set of blades (24) which are curved, and preferably of aerofoil cross-section, in a manner which causes fluid flow passing through the set of blades to be turned with respect to the blades through an angle more than 90°, preferably 100° to 140°. The rotor is enclosed in stator structure (20) defining a toroidal passage (25) between inlet and outlet ports (26, 27) fluid flow in said passage following a path which forms a spiral centered within the cross section of the passages so that it passes through the set of blades more than once between the inlet and outlet.

18 Claims, 5 Drawing Figures

REGENERATIVE TURBO MACHINE

DESCRIPTION

This invention relates to regenerative fluid dynamic turbo machines with particular reference to regenerative blowers for compressing, pumping, boosting or exhausting air or other gases though it is contemplated that a machine embodying the invention may also operate as a pneumatic or other fluid motor or turbine.

Regenerative (also referred to as "side channel" or "vortex flow") blowers are well known; some examples of known constructions are described in British Pat. Nos. 1,048,364, 1,116,753, 1,127,299, 1,225,704 and 1,287,557 all of Rotron Manufacturing Company; and 1,237,363 of N.R.D.C.

The basic principle is that a rotor revolves within a stator or casing defining an annular channel which accommodates a peripheral part of the rotor, this part being provided with a plurality of vanes (which may be blades, hollows or bucket formations). The channel walls are spaced from the vanes to form an open toroidal passage extending angularly around a major portion (e.g. about 340°) of said periphery between inlet and outlet ports in the casing, the remaining minor portion being reduced in cross section by a stripper formation of the casing to minimum clearance over the vanes so as to permit their rotation but, so far as practicable, prevent or restrict passage of fluid through that minor portion between the inlet and outlet ports.

In operation fluid follows a path between the inlet and outlet ports which has compound curvature, not only passing around the rotor axis but also spiralling in a vortex or vortices about a centre or centres within the cross section of the channel to enter and leave the rotor vanes at intervals as the rotor rotates. Thus there is interaction between the vanes and the same particles or portions of fluid several times beween the inlet and outlet so that, in the case of a blower, the equivalent of multi-stage compression is achieved using a single set of rotor blades or vanes, the fluid being acted on by the same set of blades or vanes more than once during its passage through the channel.

The object of the invention is to provide a regenerative turbo machine, and in particular a regenerative blower or exhauster, which is particularly efficient, reliable and economic.

According to the invention there is provided a fluid dynamic machine including a rotor, a peripheral part of which is provided with a set of blades; and a stator including structure defining an annular channel accommodating said peripheral part, the walls of said channel being spaced from the set of blades to form an open toroidal passage extending angularly around a major portion of said periphery between inlet and outlet ports of the stator and the remaining angular extent of said channel having minimum clearance about said blades; said blades being curved to give a turning angle as hereinafter defined of substantially more than 90° to fluid flow through the set of blades in use, fluid transmitted through said passage coacting with said blades to follow a spiral path entering and leaving said set of blades more than once as the rotor rotates in use.

A specific embodiment of the invention is now more particularly described (together with certain modifications and alternative constructions) with reference to the accompanying drawings wherein.

Figure 1:
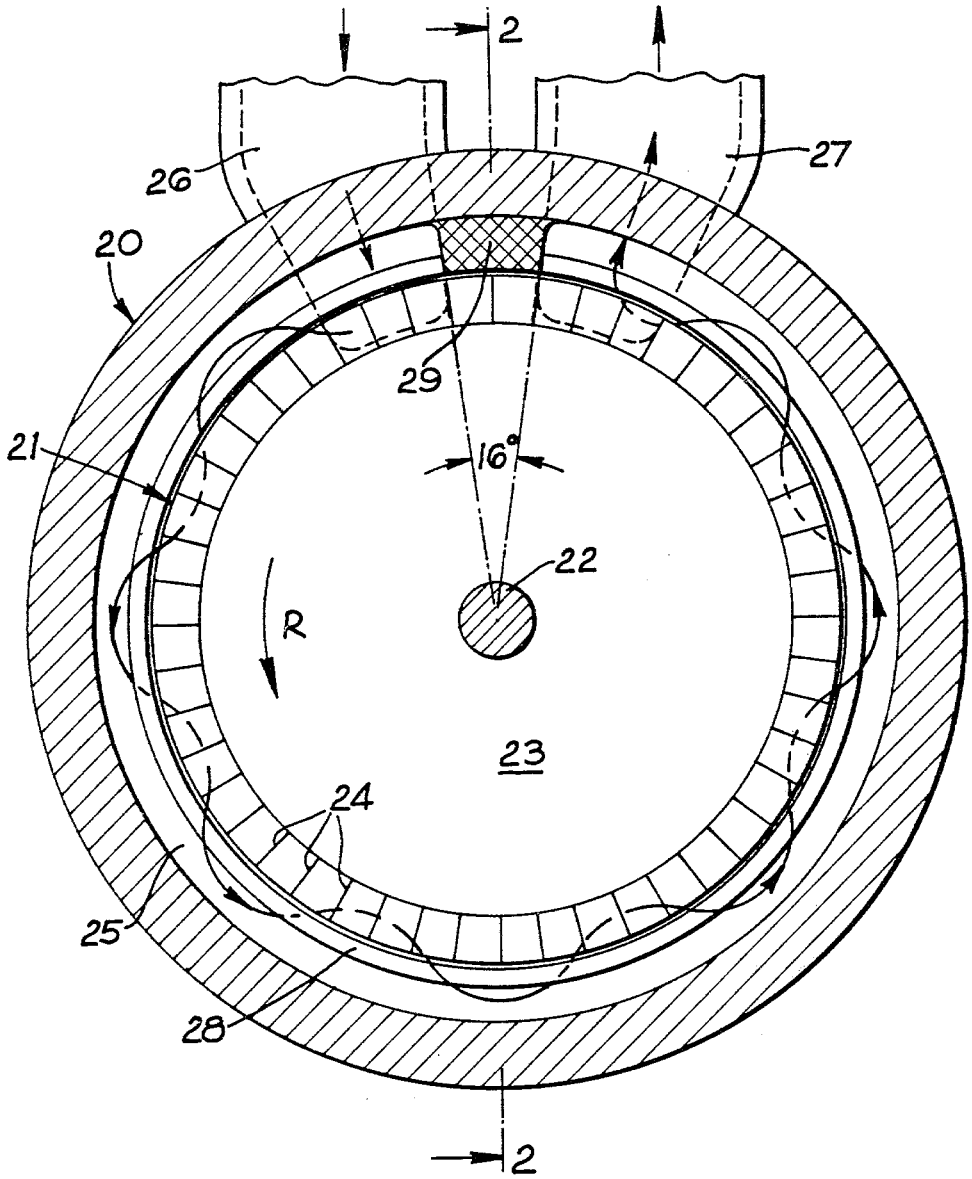
FIG. 1 is a section on a median plane normal to the rotor axis of a regenerative blower.
Figure 2:
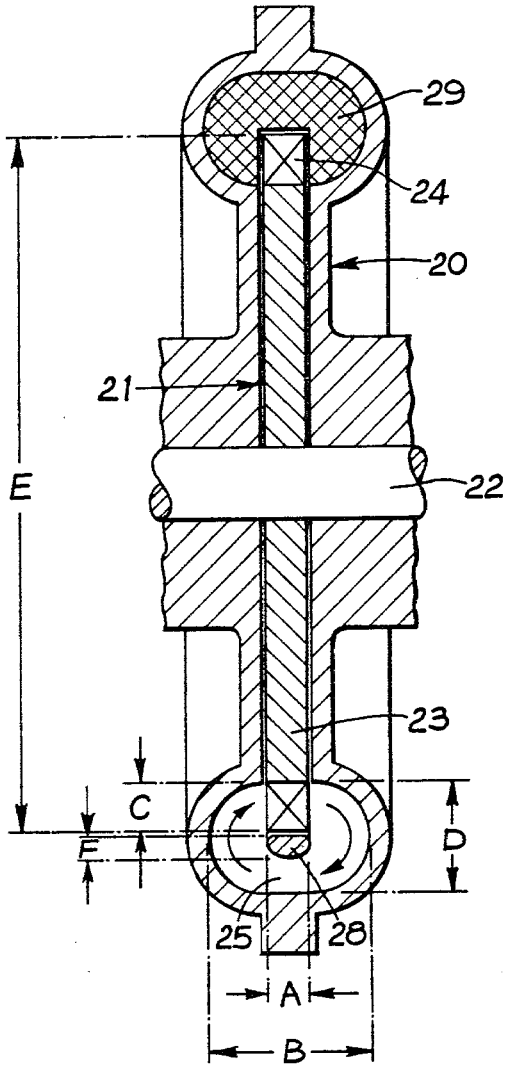
FIG. 2 is a section on line 2—2 of FIG. 1.
Figure 3:
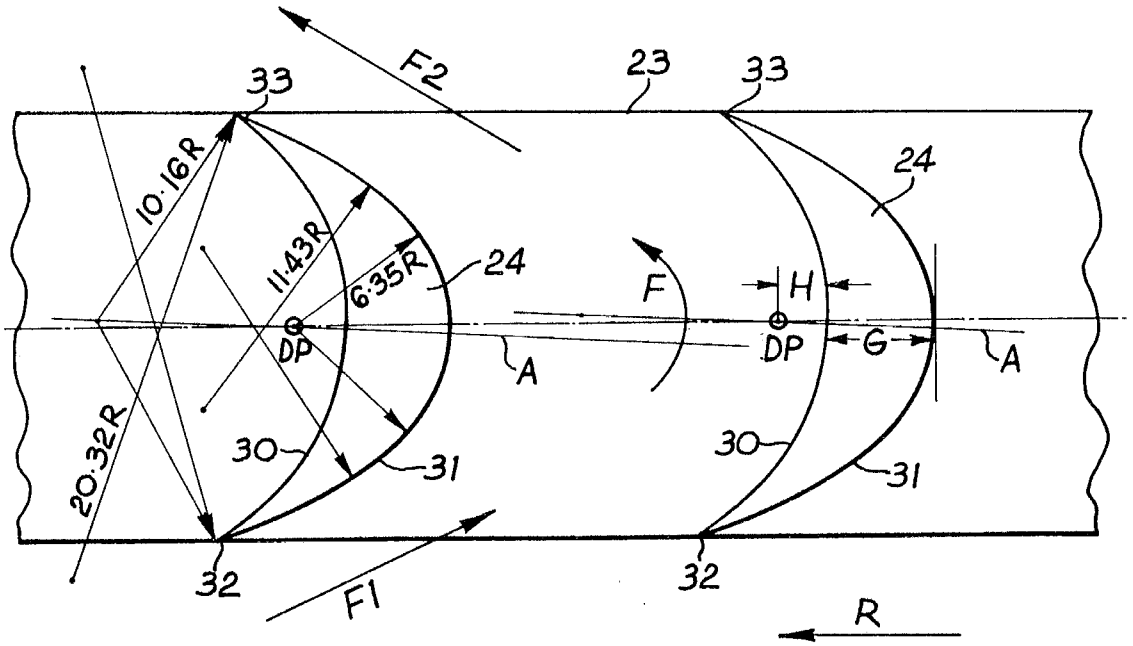
FIG. 3 shows details of the shape and disposition of blades on a rotor of said blower.

Referring firstly to FIGS. 1–3 a regenerative blower has a stator or casing 20 enclosing a rotor 21 carried on a drive shaft 22 which may be common to an electric motor or directly or indirectly coupled thereto or to some other means of rotary drive. Rotor 21 is formed of aluminium or other light alloy and includes a solid main disc 23 and 48 equi-angularly spaced aerodynamic vanes or blades 24 extending radially from the disc periphery.

Casing 20 defines an annular channel in surrounding relationship to blades 24. Over an angular extent of about 345° about the rotor axis said channel is oval in radial section to form an open toroidal passage 25 of uniform cross section throughout its angular extent. Passage 25 extends between inlet and outlet ports 26, 27 defined by the casing 20.

A fixed shroud 28 in the form of a ring of strip metal having rounded edges is mounted at the centre of passage 25 with minimum practicable running clearance from the radially outer edges of the blades 24. The radially outer face of the shroud is convex to assist in smooth guidance of the flow.

The remaining angular zone of about 16° of the annular passage, lying directly between said ports, is defined by a stripper formation 29 fitting around the radial section of the rotor 21 with the minimum practicable running clearance to prevent, so far as possible, any substantial quantity of compressed fluid being carried with the rotor from the outlet to the inlet ends of passage 25. It is contemplated that stripper formation 29 may be provided with bleed passages or ducts, for example similar to those described in the said NRDC patent 1237363, leading back to intermediate regions of passage 25 to recycle pressurised fluid being carried through the stripper back to an area of said passage which is at an appropriate pressure during operation to prevent loss of efficiency.

The angular extent of stripper formation 29 is sufficient to embrace at least two successive spacings between adjacent blades 24, i.e. about 16° (see FIG. 1).

Referring to FIG. 3 each blade 24 is of sharply curved aerofoil section in a plane tangential to the rotor (hereinafter referred to as the "cross section" of the blade). Each blade has a concave and leading face 30 of constant curvature leading in the direction of operative rotation of the rotor indicated by arrow R and a convex trailing face 31 of compound curvature.

In FIG. 3 axes A are the centre lines of each blade on which the curvature of leading face 30 and the least radiussed median portion of convex face 31 is centred, the centre of the latter portion being taken as a datum point DP. The blades are symmetrical on each side of axis A, the semi-arcs of convex trailing face 31 being three centred at increased radii towards entry and exit tips 32, 33 of the respective blades as detailed in FIG. 3, but each blade is slightly angled with respect to the centre line of the rotor periphery by 2° measured at DP so that the blade entry tips 32 to one side face of the rotor are slightly in advance of the exit tips 33 on the opposite side to induce flow through the blades in the general direction of arrow F (FIG. 3) during rotation.

It is believed that an important feature contributing to the efficiency of this design is the angle through which the fluid is "turned" during its passage between the blades; substantially in excess of 90°, preferably 100°–140°, and in the example shown in the drawings, approximately 125°. This "turning angle" is assessed with respect to a line normal to blade centre axis A (if the fluid travelled along this reference line it would pass straight through without any turning—turning angle 0°). With the curved blades its flow path can be resolved into two turning stages for simplicity in arriving at angles for comparison purposes; firstly it enters in the direction of arrow F1 between tips 32 at an angle midway between the tangent of the curvature of the convex trailing face 31 of the leading one of the pair of blades at its entry tip 32 and the tangent of the concave leading face 30 of the trailing one of said pair and is turned until it is normal to axis A, secondly this turning is doubled (in the case of symmetrically curved blades) as it leaves the blades at exit tips 33 in the direction of arrow F2 taking tangents in the same way. The passages between the blades along which flow takes place increase slightly in cross section from the entry to the exit side of the set of blades.

This rotor construction gives effective transfer of momentum from the blades to the flowing fluid and a satisfactory velocity of flow through the blades consonant with acceptable friction losses therein, while velocity levels and turbulence in passage 25 (and resulting friction losses e.g. due to contact with the stationary passage walls) are kept at levels at which adverse effects are minimised.

In the machine shown in FIGS. 1–3 the following dimensions were employed:

| Dimensions indicated on FIG. 2 | | |
|---|---|---|
| | | mm |
| A | Width of blades 23 | 17.8 |
| B | Width of passage 25 | 65 |
| C | Radial height of blades 23 | 22 |
| D | Radial height of passage 25 | 47 |
| E | Overall rotor diameter | 304 |
| F | Radial thickness of shroud | 7 |
| **Dimensions indicated on FIG. 3** | | |
| G | Max. blade thickness (on axis A) | 4.3 |
| H | Distance of DP from leading face 30 | 2.14 |
| | Radii and geometry of curvature of blade faces 30 and 31 as shown in FIG. 3 (all radii R in mm). | |

Number of blades - 48

Thus in this working example the blade width A is approximately 27% of passage width B; blade height C is approximately 47% of passage height D; and the "turning angle" (as defined above) is approximately 125°. The ratio of blade height C to blade width A is 1.22; it has been found desirable for better performance that the height be greater than the width. Also for best performance the cross sectional area of the passage 25 has to be carefully selected to give unimpeded flow with the open area in correct relationship to the cross-sectional area occupied by the blades (blade width A x blade height C). A ratio of 6:1 of said respective areas appears to give good performance in practice.

A machine made to the above dimensions gave an isothermal efficiency of 32.5% at 1.17 pressure ratio compared to 22% isothermal efficiency for a "side channel" blower of conventional design, and developed a pressure head substantially greater than that achievable by the conventional blower.

The invention may be embodied in other constructions, for example as follows.

Figure 4:
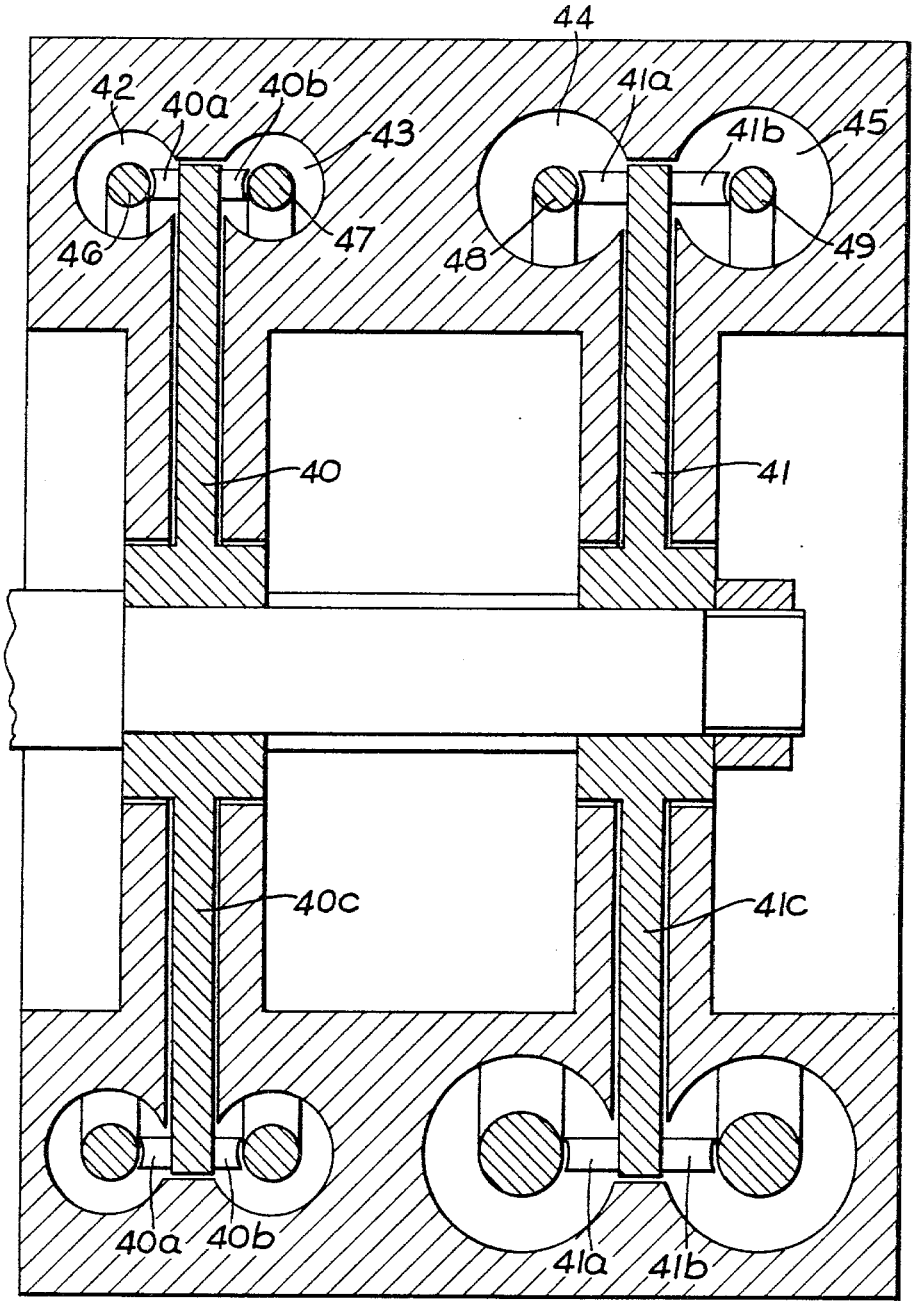
FIG. 4 is a diagrammatic cross-section in a plane including the axis of another form of blower.

FIG. 4 is a diagrammatic section of a twin rotor two stage machine, each rotor 40, 41 having a pair of sets of aerofoil blades 40*a,b*: 41*a*, 41*b* projecting axially in opposite directions from respective radial faces of the rotor main discs 40*c*, 41*c*, each set of vanes operating in a respective separate toroidal passage 42–45. In this case the passages are of non-uniform cross-section and fixed shrouds 46–49 of non-uniform cross section are used.

Figure 5:
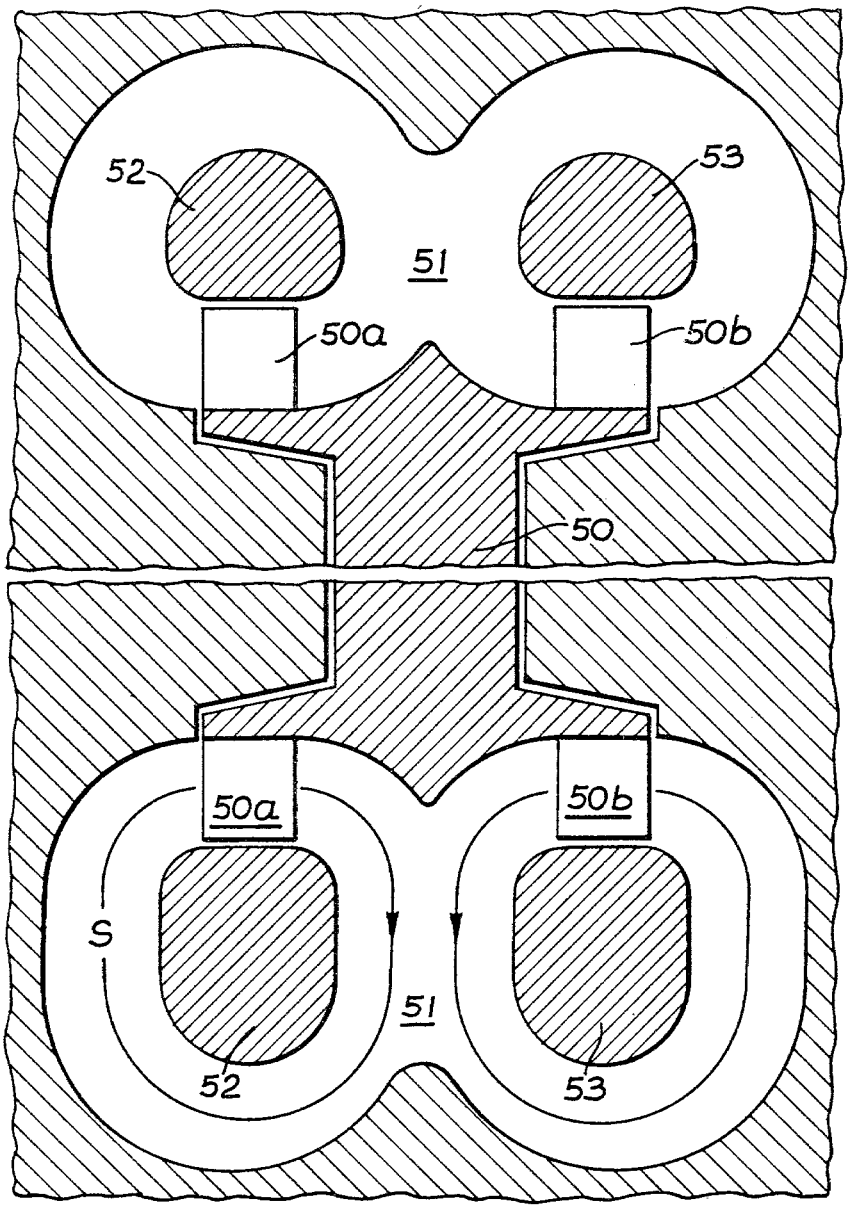
FIG. 5 is a like section (central part broken away) of a third form of blower.

FIG. 5 shows a machine having another form of double-bladed rotor 50 having a double-flanged disc (central part and shaft not shown) with two sets of radially projecting blades 50*a, b* extending into a double or figure 8 shaped passage 51 so that a pair of vortices rotating in opposite directions as indicated by the arrows in the lower part of FIG. 5 is created. There is no dividing wall between the two flows which move in the same direction radially outwards of the rotor at the centre of passage 51 and this arrangement may help to reduce friction losses in the passage as contact with fixed walls is reduced.

Again fixed shrouds 52, 53 are used mounted on the stator or casing as close as possible to the tips of the respective sets of blades and passage 51 is of non-uniform radial cross-section, said section reducing smoothly from the inlet to the outlet. This latter arrangement may be desirable (and could be incorporated in the embodiment of FIGS. 1–3) in very high performance machines though in lower performance machines its effect may be unnecessary as the fluid is not only compressed but also expanded by heating during passage through the blower.

The rotor blades might be asymmetrically curved instead of being symmetrical on each side of axis A as in FIG. 3 and may be given other aerodynamic cross sections of aerofoil type e.g. having a lengthened and less sharply curved trailing edge portion and/or providing a more sharply constricted "throat" between adjacent blades.

The number of blades on the rotor may also be varied, a number greater than 48 will give increased high pressure efficiency. Provisions such as labyrinth formations may be provided to give better sealing between the rotor and casing e.g. in the central region radially inwardly of the blades.

The use of shrouds which are mounted on the blade tips, for example by being shrink-fitted or otherwise secured thereto, so that they revolve with the associated rotor is also contemplated.

We claim:

1. A fluid dynamic machine including a rotor, a peripheral part of which is provided with a set of blades, and a stator including structure defining an annular channel accommodating said peripheral part, the walls of said channel being spaced from the set of blades to form a continuous toroidal passage extending angularly around a major portion of said periphery between inlet and outlet ports of the stator and the remaining angular extent of said channel having minimum clearance about said blades, said blades having a concave face leading in the direction of operative rotation of the rotor and a convex trailing face of substantially greater overall curvature than that of said leading face to provide each blade with an aerofoil cross-section, the curvature of said faces causing fluid flow passing between the blades to be subjected to a change of direction through a turning angle of at least 100° measured from entry of said flow between entry tips of a pair of adjacent blades at an angle mid-way between tangents to the curvature at said entry tips of the convex trailing face of the leading one of the pair and of the concave leading face of the trailing blade respectively to exit of said flow between exit tips of said pair at an angle mid-way between like tangents to the curvature of the respective blade faces at said exit tips, fluid transmitted through said toroidal passage co-acting with said blades to follow a substantially spiral path passage through the set of blades more than once as the rotor rotates in use.

2. A machine as in claim 1 wherein in each blade the leading face is of uniform curvature and the trailing face is of compound curvature increasing in radius laterally towards entry and exit tips of the blades.

3. A machine as in claim 2 wherein each blade is symmetrically curved to each side of a centre line of the blade.

4. A machine as in claim 3 wherein said centre line is angled with respect to a centre line of the rotor periphery so that the entry tips of the blades are in advance of the exit tips thereof.

5. A machine as in claim 4 wherein the blade centre lines are angled at 2° with respect to the rotor periphery centre line.

6. A machine as in claim 1 wherein said turning angle is 100° to 140°.

7. A machine as in claim 1 wherein said turning angle is substantially 125°.

8. A machine as in claim 1 wherein the peripheral extent of said channel having minimum clearance about said blades is angularly sufficient to embrace at least two successive spacings between adjacent blades of the set.

9. A machine as in claim 8 wherein there are 48 blades in the set and the angular extent of said minimum clearance is about 16°.

10. A machine as in claim 1 wherein the blades extend radially of the rotor with their width axially of the rotor being approximately 27% of the width of said passage, the radial height of the blades being approximately 47% of the radial height of the passage.

11. A machine as in claim 10 wherein the radial height of the blades is greater than their axial width.

12. A machine as in claim 1 including a fixed shroud mounted at the centre of the toroidal passage with minimum running clearance from outer edges of the rotor blades.

13. A machine as in claim 1 including an annular shroud mounted on the outer edges of the rotor blades for rotation through the centre of the toroidal passage.

14. A machine as in claim 1 wherein the rotor includes a pair of sets of blades, each set being accommodated in a respective annular channel of the stator.

15. A machine as in claim 14 wherein the sets of blades extend axially of the rotor on opposite sides of a peripheral part thereof.

16. A machine as in claim 14 wherein the sets of blades extend radially of the rotor into a double or figure 8 shaped passage having no dividing wall between the respective spiral paths of fluid through the sets of blades, said paths rotating in opposite directions with respect to the cross section of the double passage.

17. A machine as in claim 1 wherein the toroidal passage is of non-uniform radial cross-section reducing from the inlet to the outlet port.

18. A machine as in claim 17 including a fixed shroud of non-uniform cross section mounted at the centre of the toroidal passage with minimum running clearance from outer edges of the rotor blades.

* * * * *